US009145190B2

(12) United States Patent
Knecht et al.

(10) Patent No.: US 9,145,190 B2
(45) Date of Patent: Sep. 29, 2015

(54) MULTI-SIDED COLUMN DESIGN FOR SEMISUBMERSIBLE

(71) Applicant: Exmar Offshore Company, Houston, TX (US)

(72) Inventors: Harris Knecht, Houston, TX (US); Otto Dasilva, Houston, TX (US); Marty Knapp, Houston, TX (US)

(73) Assignee: Exmar Offshore Company, Houston, TX (US)

( * ) Notice: Subject to any disclaimer, the term of this patent is extended or adjusted under 35 U.S.C. 154(b) by 109 days.

(21) Appl. No.: 13/861,912

(22) Filed: Apr. 12, 2013

(65) Prior Publication Data

US 2014/0305363 A1 Oct. 16, 2014

(51) Int. Cl.
*B63B 35/44* (2006.01)
*B63B 9/06* (2006.01)

(52) U.S. Cl.
CPC ..... *B63B 35/44* (2013.01); *B63B 9/065* (2013.01); *B63B 2009/067* (2013.01); *Y10T 29/49826* (2015.01)

(58) Field of Classification Search
USPC ..... 114/264
IPC ..... B63B 35/4413
See application file for complete search history.

(56) References Cited

U.S. PATENT DOCUMENTS

| | | | | |
|---|---|---|---|---|
| 1,502,247 | A * | 7/1924 | Hanberg | 433/29 |
| 4,651,486 | A * | 3/1987 | Erickson et al. | 52/306 |
| 2005/0058513 | A1 | 3/2005 | Martensson et al. | |
| 2011/0114005 | A1 | 5/2011 | Williams et al. | |
| 2012/0201609 | A1 | 8/2012 | Foote | |
| 2013/0000541 | A1 | 1/2013 | Rijken et al. | |

OTHER PUBLICATIONS

Zapata Arctic; p. 975; Dayton's Guide to Mobile Drilling Units Published by Oilfield Publication Limited (1989); (1 page).
Transocean 8; p. 850; Dayton's Guide to Mobile Drilling Units Published by Oilfield Publication Limited (1989); (1 page).
Office Action issued in corresponding Singaporean Application No. 10201401374Q; Dated Jul. 3, 2015 (10 pages).

* cited by examiner

*Primary Examiner* — Stephen Avila
(74) *Attorney, Agent, or Firm* — Osha Liang LLP

(57) ABSTRACT

A support structure includes a column having multiple sides. A first side and a second side of the column are disposed at a first angle with respect to another. The second side and a third side of the column are disposed at a second angle with respect to another. The third side and a fourth side of the column are disposed at a third angle with respect to another. The fourth side and a fifth side of the column are disposed at a fourth angle with respect to another. The fifth side may be disposed at a fifth angle with respect to a sixth side and/or the first side of the column, in which the sixth side and the first side of the column may be disposed at a sixth angle with respect to another.

35 Claims, 11 Drawing Sheets

MULTI-SIDED COLUMN DESIGN FOR SEMISUBMERSIBLE

FIELD OF THE DISCLOSURE

Embodiments disclosed herein generally relate to a support structure. More specifically, embodiments disclosed herein relate to a multi-sided support column for use in an offshore semi-submersible.

BACKGROUND

In oilfield exploration and production operations, floating vessels, such as semi-submersibles ("semis"), are commonly used for various offshore tasks, including, but not limited to, drilling rigs, safety platforms, and heavy lift cranes. For example, in an offshore environment with water depth greater than 120 meters, semis are used in because a fixed structure is not practical to build, maintain, or support in such great water depths. Furthermore, semis are advantageous over other floating vessels, such as drillships, as drillships are unstable in rough offshore conditions having large waves and strong tidal forces. As would be understood by one having ordinary skill, offshore semis are not limited to the aforementioned water depths described in the above example.

Referring to FIG. 1, a side view of a semi-submersible 113 in a typical marine environment is shown. A deck 101 sits above the surface of water 111. The deck 101 is typically used for drilling, production, or other operations and therefore operating equipment, personnel, and operation gear may be disposed thereon. The deck 101 may be supported by one or more support columns. As shown in this example, the deck 101 is disposed on support columns 103A and 103B and is therefore kept away from any large waves at the surface of the water 111. Support columns 103A and 103B are used to support the deck 101, but may also serve as storage. In addition, support columns 103A and 103B may be ballasted. A pontoon base 105 has the support columns 103A and 103B disposed thereon. The pontoon base 105 may be substantially rectangular in shape from a side view perspective, a plan view perspective, or both.

The semi-submersible 113 obtains buoyancy from ballasted pontoons or ballasted columns. As such, the ballasted structure(s) (ballasted pontoons or ballasted columns or both) may be filled with water or any other ballasting material (ballasting) or may release water or any other ballasting material (deballasting) to stabilize the semi-submersible 113. As shown, the semi-submersible 113 is anchored to the seabed 109 by anchor lines 107A and 107B. The anchor lines 107A and 107B may be wires, chains, or any other anchoring device known in the art that would keep the semi-submersible in a proper position with respect to the seabed 109. Furthermore, anchor lines may not be limited to only two lines as shown in this example. The semi-submersible 113 may be anchored by any number of anchor lines.

Alternatively, for use in marine environments with a shallower water depth, the semi-submersible 113 may be adapted to be disposed on seabed 109 without the use of anchor lines 107A and 107B. In this case, pontoon base 105 may be disposed on the seabed 109 and may be affixed to the seabed 109 using an affixing unit (not shown) to affix the pontoon base 105 and ultimately, the semi-submersible 113, to the seabed 109.

SUMMARY

In general, in one aspect, the present disclosure relates to a support structure for a floating offshore structure, the support structure including a column having six sides, a first side of the column and a second side of the column disposed at a first angle with respect to each other, the second side of the column and a third side of the column disposed at a second angle with respect to each other, the third side of the column and a fourth side of the column disposed at a third angle with respect to each other, the fourth side of the column and a fifth side of the column disposed at a fourth angle with respect to each other, the fifth side of the column and a sixth side of the column disposed at a fifth angle with respect to each other, and the sixth side of the column and the first side of the column disposed at a sixth angle with respect to each other.

In general, in another aspect, the present disclosure relates to a method of manufacturing a column for a floating offshore structure, the method including disposing a first side of the column and a second side of the column at a first angle with respect to each other, disposing the second side of the column and a third side of the column at a second angle with respect to each other, disposing the third side of the column and a fourth side of the column at a third angle with respect to each other, disposing the fourth side of the column and a fifth side of the column at a fourth angle with respect to each other, disposing the fifth side of the column and a sixth side of the column at a fifth angle with respect to each other, and disposing the sixth side of the column and the first side of the column at a sixth angle with respect to each other.

In general, in another aspect, the present disclosure relates to a support structure for a floating offshore structure, the support structure including a column having five sides, a first side of the column and a second side of the column disposed at a first angle with respect to each other, the second side of the column and a third side of the column disposed at a second angle with respect to each other, the third side of the column and a fourth side of the column disposed at a third angle with respect to each other, the fourth side of the column and a fifth side of the column disposed at a fourth angle with respect to each other, the fifth side of the column and the first side of the column disposed at a fifth angle with respect to each other, in which at least one side of the column comprises a taper position such that the at least one side flares outwardly or inwardly along at least a portion of the length of the column.

In general, in yet another aspect, the present disclosure relates to a support structure for a floating offshore structure, the support structure including a column having six sides, a first side of the column and a second side of the column disposed at a substantially right angle with respect to each other, the second side of the column and a third side of the column disposed at a substantially obtuse angle with respect to each other, the third side of the column and a fourth side of the column disposed at a substantially obtuse angle with respect to each other, the fourth side of the column and a fifth side of the column disposed at a substantially right angle with respect to each other, the fifth side of the column and a sixth side of the column disposed at a substantially obtuse angle with respect to each other, and the sixth side of the column and the first side of the column disposed at a substantially obtuse angle with respect to each other.

In general, in yet another aspect, the present disclosure relates to a support structure for an offshore structure, including a column having five sides, a first side of the column and a second side of the column disposed at a substantially right angle with respect to each other, the second side of the column and a third side of the column disposed at a substantially right angle with respect to each other, the third side of the column and a fourth side of the column disposed at a substantially obtuse angle with respect to each other, the fourth side of the column and a fifth side of the column disposed at a substantially obtuse angle with respect to each other, and the fifth side of the column and the first side of the column disposed at a substantially right angle with respect to each other, in which at least one side of the column comprises a taper position such that the at least one side flares outwardly or inwardly along at least a portion of the length of the column.

In general, in yet another aspect, the present disclosure relates to a method of manufacturing a column for an offshore structure, the method including disposing a first side of the column and a second side of the column at a first angle with respect to each other, disposing the second side of the column and a third side of the column at a second angle with respect to each other, disposing the third side of the column and a fourth side of the column at a third angle with respect to each other, disposing the fourth side of the column and a fifth side of the column at a fourth angle with respect to each other, and disposing the fifth side of the column and a sixth side of the column at a fifth angle with respect to each other.

Other aspects and advantages of the disclosure will be apparent from the following description and the appended claims.

DETAILED DESCRIPTION

Figure 1:
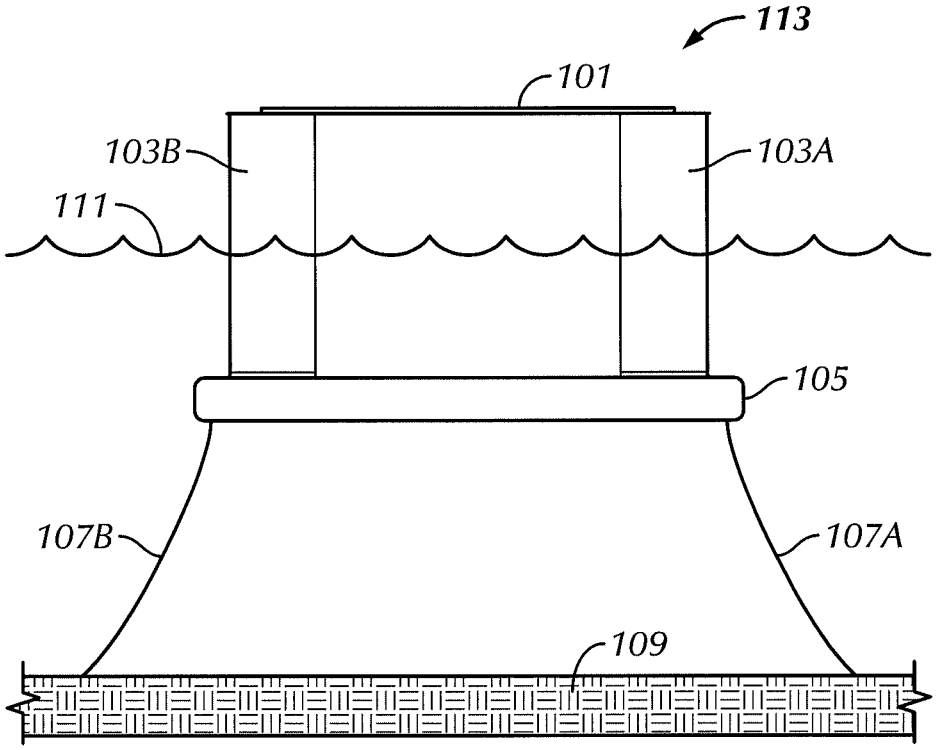
FIG. 1 shows a semisubmersible used in a typical offshore environment in accordance with one or more embodiments of the present disclosure.

Specific embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the invention. However, it will be apparent to one of ordinary skill in the art that the embodiments disclosed herein may be practiced without these specific details. In other instances, well-known features have not been described in detail to avoid unnecessarily complicating the description.

Furthermore, those having ordinary skill in the art will appreciate that when describing a first element to a second element disposed thereon, it is understood that disposing may be either directly disposing the first element on the second element, or indirectly disposing the first element on the second element. For example, a first element may be directly disposed on a second element, such as by having the first element and the second element in direct contact with each other, or a first element may be indirectly disposed on a second element, such as by having a third element, and/or additional elements, disposed between the first and second elements.

In one aspect, embodiments disclosed herein generally relate to a support column having multiple sides. In addition, the support column may be designed for use with offshore vessels, in particular, offshore floating vessels, such as semi-submersibles or single column floating vessels. Additionally, the offshore vessels may be in any marine environment without departing from the scope of the present disclosure.

A support column may include any number of sides or faces. An example of a support column with a single side or face may be a column whose two-dimensional cross-section is a circle and the column shape is generally cylindrical or contains only a single edge. A support column with more than one side may be a column whose two-dimensional cross-section is substantially semi-circular, triangular, quadrangular, or any other shape. Additionally, the cross-section of a support column may contain only a single edge or any other number of edges.

A cross-section with a single edge may correspond to any number of sides of support columns, as the edge may represent where two sides of a column join. Here, the two sides of a column may be joined by a rounded edge, for example. Alternatively, a cross-section with a single edge may also correspond to a support column with only one side as described above. As such, the cross-section of a support column may not directly correspond to the number of sides of the support column. Therefore, one of ordinary skill would know and appreciate that embodiments herein discuss a support column and cross-sections of a support column; however, the support column and the cross-sections may or may not correspond to one another.

Additionally, the cross-section of a support column, in accordance with embodiments of the present invention, may or may not be symmetric. For example, the cross-section of a cylindrical support column is generally circular. In this case, any line drawn across the diameter of the cross-section would split the cross-section into two halves. The result is two equal halves of the circular cross-section that are mirror images of each other along the line that was drawn. More particularly, a 180 degree rotation of one of the halves with respect to the drawn line would result in the rotated half looking exactly the same as the half that was left un-rotated. Essentially, the rotated half would overlap exactly the same surface area of the half that was stationary and the drawn line may be called an axis of symmetry. Unique to a circular cross-section is that there are infinitely many lines that may be drawn that can result in the splitting of the circular cross-section into two equal halves that are mirror images of one another. In other words, a support column with a circular cross-section may have an infinite number of axes of symmetry.

In one or more embodiments, a cross-section of a support column may not have any axes of symmetry. More specifically, a line drawn across the cross-section of a support column in accordance with one or more embodiments of the present disclosure would not result in two equal halves of the cross-section. Further, in one or more embodiments, a cross-section of a support column in accordance with the present disclosure may have only one axis of symmetry. Moreover, in one or more embodiments, a cross-section of a support column may have no more than two axes of symmetry. Embodiments of the present disclosure include cross-sections that may or may not be symmetric. One of ordinary skill in the art would know and appreciate that embodiments of the present disclosure are not limited to the number of axes of symmetry, as described in the above and following examples.

Figure 2A:
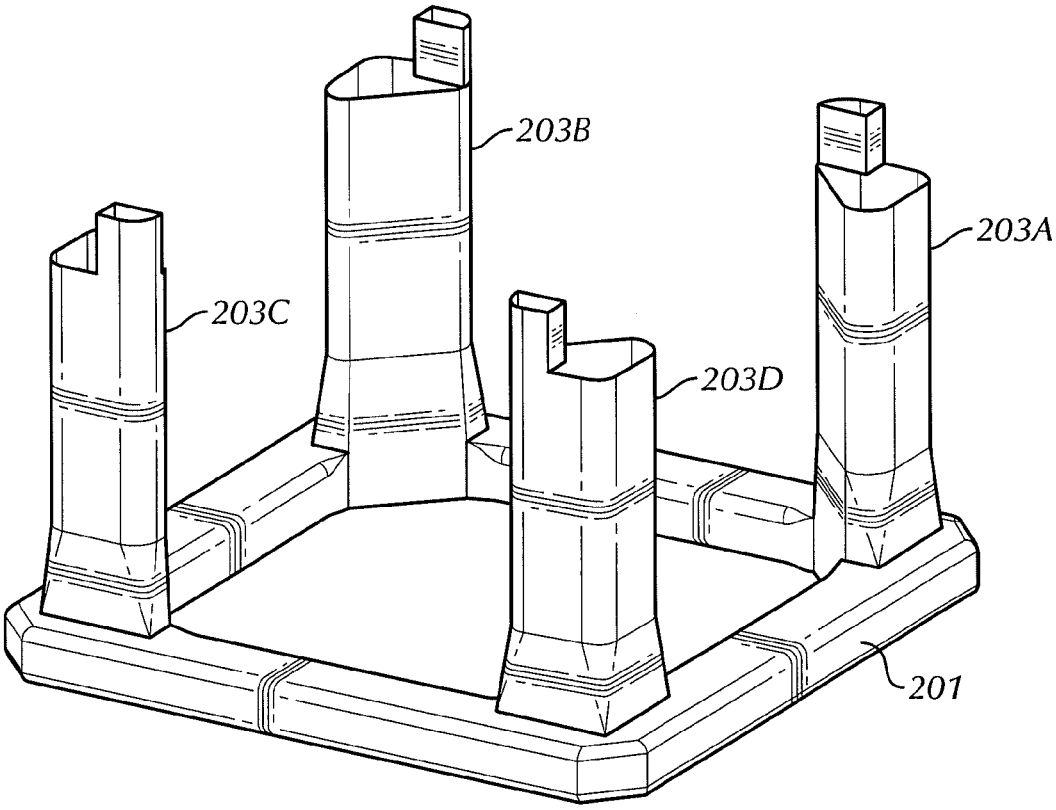
FIGS. 2A-2E illustrate several views of a semi-submersible having multi-sided support columns in accordance with one or more embodiments of the present disclosure.

In one or more embodiments, a support column may be disposed on a pontoon structure. Referring to FIG. 2A, a perspective view of a pontoon structure 201 in accordance with one or more embodiments of the present disclosure is shown. The pontoon structure 201 may include one or more pontoons connected to each other and may have one or more support columns disposed thereon. As shown, support columns 203A, 203B, 203C, and 203D are disposed on the pontoon structure 201. Also, in this case, the pontoon structure 201 may be generally rectangular, triangular, and/or polygonal in shape and the support columns 203A, 203B, 203C, and 203D may be disposed near the corners of or at any position along the pontoon structure 201. One of ordinary skill in the art would know and appreciate that the position of the support columns 203A, 203B, 203C, and 203D are not limited to the corners of the pontoon structure 201, as the support columns 203A, 203B, 203C, and 203D may be arranged in any other configuration with respect to the pontoon structure 201. In addition, one of ordinary skill in the art would know and appreciate that the number of support columns is not limited to four support columns 203A, 203B, 203C, and 203D, as shown, as there may be any number of support columns.

Figure 2B:
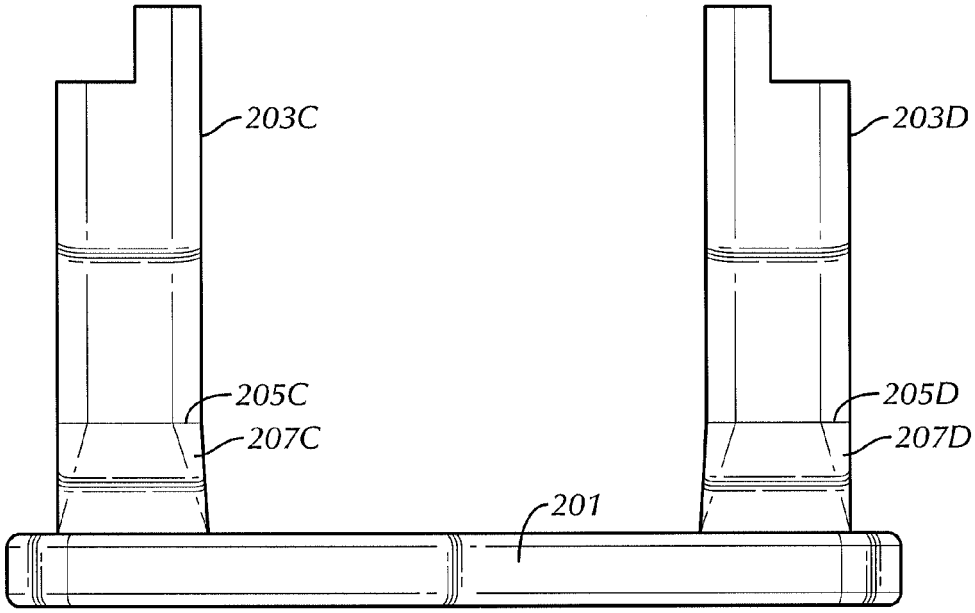
Figure 2C:
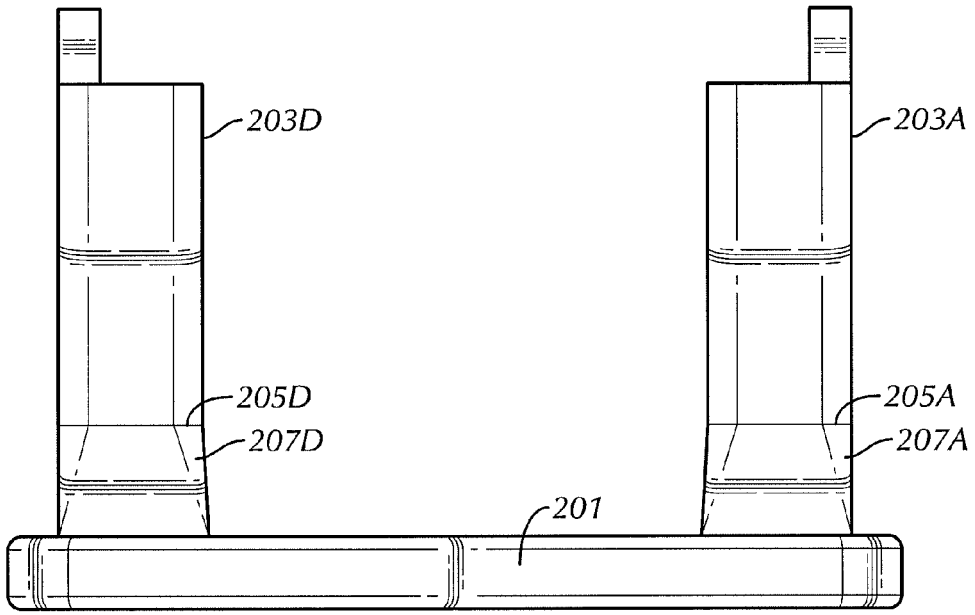

Referring to FIG. 2B and FIG. 2C, a side view of the structure described in FIG. 2A in accordance with one or more embodiments of the present disclosure is shown. Specifically, the pontoon structure 201 may have support columns 203C and 203D disposed thereon, as shown in FIG. 2B. Further, the pontoon structure 201 may have support columns 203D and 203A disposed thereon, as shown in FIG. 2C. In addition, lines 205C, 205D, and 205D, 205A are shown to illustrate a vertical position along the support columns in which the sides of the columns join across a rounded edge and may gradually transition to joining across a squared edge. Regions 207C, 207D, and 207D, 207A represent transition regions in which a rounded corner may gradually transition to a squared corner. In this example, the transition regions extend along a portion of the support column and terminate at the connection between the support column and the pontoon structure 201. One of ordinary skill in the art would know and appreciate that the sides of the column may be joined across a rounded edge, a squared edge, an edge that gradually changes from a rounded edge to a squared edge, or any other joining thereof.

Figure 2D:
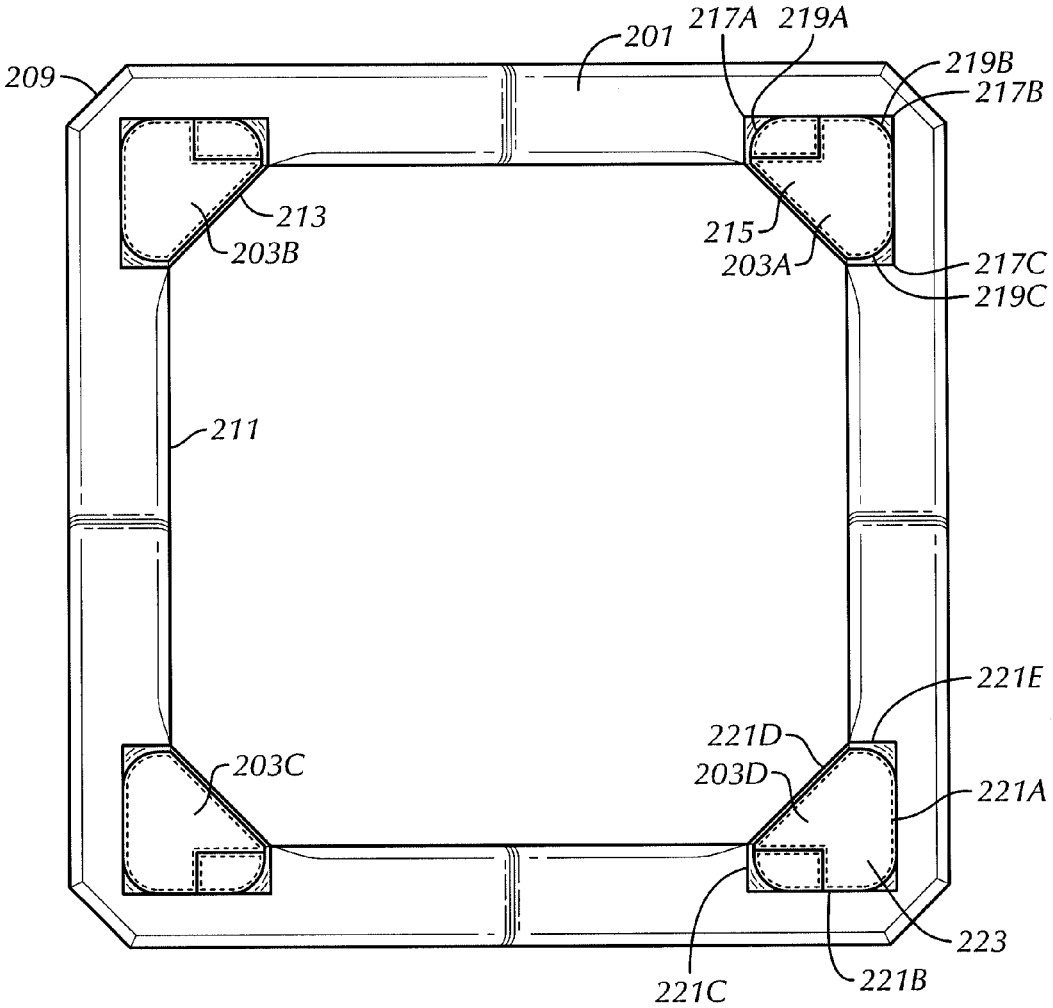

Referring to FIG. 2D, a top view of the structure described in FIG. 2A in accordance with one or more embodiments of the present disclosure is shown. As shown in FIG. 2D, a pontoon structure 201 may be generally rectangular, triangular, and/or polygonal in shape. In addition, one or more corners 209 of pontoon structure 201 may be chamfered (as shown). Alternatively, the pontoon structure 201 may have one or more squared corners, one or more rounded corners, or any combination or alternative thereof (not shown). Further, and similarly, the interior 211 of the pontoon structure 201 may have one or more chamfered corners 213 which may or may not correspond to the interior chamfered corners 209. Alternatively, the interior 211 of pontoon structure 201 may have one or more squared corners, one or more rounded corners, or any combination or alternative thereof (not shown).

Furthermore, as shown in FIG. 2D, the cross-section 215 of a support column may have five sides. One or more corners 217A, 217B, and 217C of the support column may be squared, as shown. In addition, one or more edges 219A, 219B, and 219C of the support column may be rounded, as shown. In this particular example, the one or more edges 219A, 219B, and 219C of the support column are rounded at one vertical end of the support column and squared at an opposite end of the support column. Moreover, one or more sides 221A, 221B, 221C, 221D, and 221E, which correspond to cross-section 223, each represent a side of a support column. Alternatively, the corners or edges may be chamfered, rounded, squared, or any combination or alternative thereof.

In addition, the interior 211 of the pontoon structure 201 and one or more chamfered corners 213 may be continuous with each other, as shown in FIG. 2D. As such, one or more chamfered corners 213 may be in alignment (or flush) with one or more of the sides of one or more of the support columns. Additionally, one skilled in the art would know and appreciate that the top view may not be limited to that which is described above and shown in FIG. 2D. One or more chamfered corners, similar to chamfered corner 213, may not be in alignment (or may not be flush) with one or more of the sides of one of the support columns, resulting in overhang, underhang, or non-continuous interior (not shown). Further, one or more chamfered corners 213 may be rounded (not shown), resulting in the interior 211 having a continuous edge (not shown).

Figure 2E:
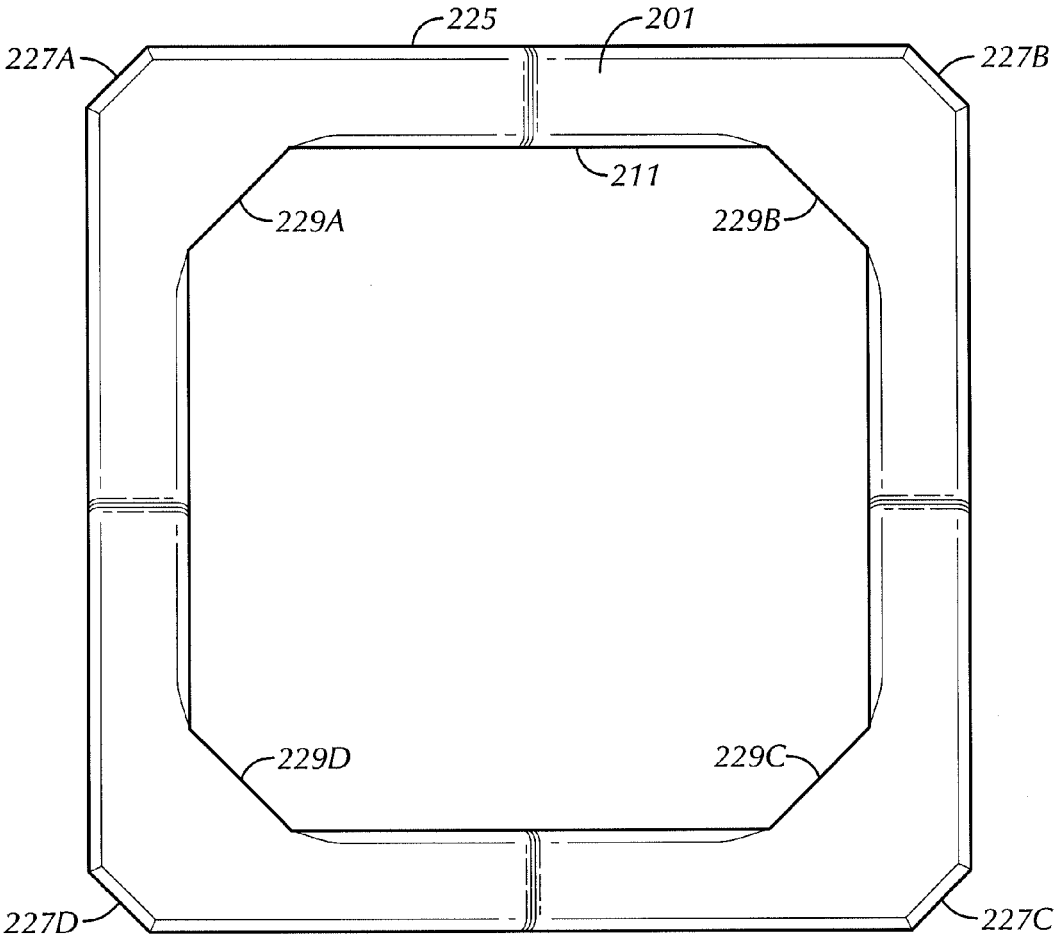

Referring to FIG. 2E, a bottom view of the structure described in FIG. 2A in accordance with one or more embodiments of the present disclosure is shown. In this view, the pontoon structure 201, along with the interior 211 and the exterior 225, is illustrated. One or more exterior corners 227A, 227B, 227C, and 227D may be chamfered, as shown, or one or more exterior corners 227A, 227B, 227C, and 227D may be squared, rounded, or any combination or alternative thereof (not shown). Similarly, one or more interior corners 229A, 229B, 229C, and 229D may be chamfered, as shown, or one or more interior corners 229A, 229B, 229C, and 229D may be squared, rounded, or any combination or alternative thereof (not shown). One of ordinary skill in the art would know and appreciate the interior corners 229A, 229B, 229C, and 229D and exterior corners 227A, 227B, 227C, and 227D should not be limited as described in the above example.

In addition, the interior 211 of the pontoon structure 201 and one or more chamfered corners, similar to chamfered corners 229A, 229B, 229C, and 229D, may be continuous with each other, as shown in FIG. 2D. Additionally, one or more chamfered corners, similar to chamfered corners 229A, 229B, 229C, and 229D may be in alignment (or flush) with at least one of the sides of at least one support column. Further, one skilled in the art would know and appreciate that the bottom view may not be limited to that which is described above and shown in FIG. 2E. One or more chamfered corners, similar to chamfered corners 229A, 229B, 229C, and 229D, may not be in alignment (or may not be flush) with one or more of the sides of the support column, resulting in overhang, underhang, or non-continuous interior (not shown). Further, one or more chamfered corners, similar to chamfered corners 229A, 229B, 229C, and 229D, may be rounded (not shown), resulting in the interior 211 having a continuous edge (not shown).

Figure 3B:
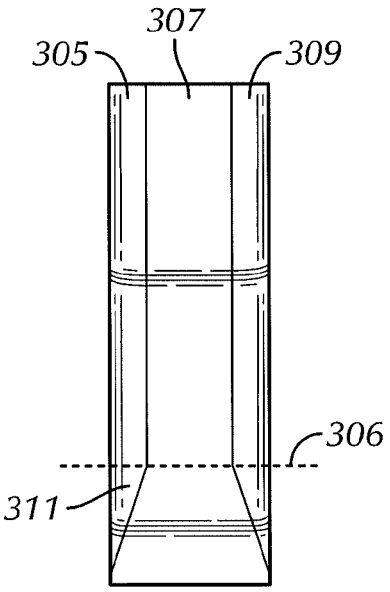
FIGS. 3A-3E illustrate several views of a multi-sided column in accordance with one or more embodiments of the present disclosure.
Figure 3C:
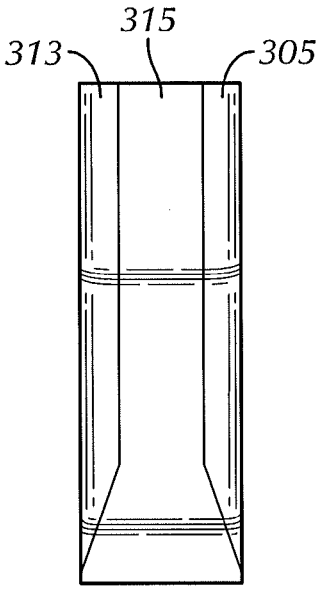
Figure 3A:
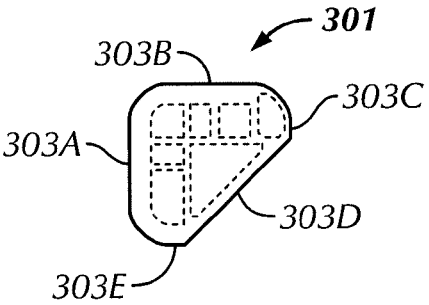

Referring now to FIG. 3A, a top view of a support column 301 in accordance with one or more embodiments of the present disclosure is shown. One or more sides 303A, 303B, 303C, 303D of the support column 301 may be disposed with respect to one another, as shown. Specifically, the first side 303A may be disposed at a first angle with respect to a second side 303B. The second side may be disposed at a second angle with respect to a third side 303C. The third side 303C may be disposed at a third angle with respect to a fourth side 303D. In this example, the first and second angle may be substantially right angles. Further, the third angle may be a substantially obtuse angle. An example obtuse angle may be substantially 135 degrees, as shown. However, an obtuse angle may be anywhere between any angle greater than 90 degrees and less than 180 degrees. Additionally, an obtuse angle may be anywhere between 91 and 179 degrees, 100 and 170 degrees, 110 and 160 degrees, 120 and 150 degrees, or 130 and 140 degrees. The fourth side 303D may be disposed at a fourth angle with respect to a fifth side 303E. The fifth side 303E may be disposed at a fifth angle with respect to the first side 303A. In this example, the fourth angle may be a substantially obtuse angle and the fifth angle may be a substantially right angle.

In this example, the one or more sides 303A, 303B, 303C, 303D of the support column 301 may be joined with rounded corners. Alternatively, the one or more sides 303A, 303B, 303C, 303D of the support column 301 may be joined with chamfered corners, squared corners, or any alternate thereof. However, one of ordinary skill in the art would know and appreciate that the corners and corresponding sides of the support column are not limited to the above arrangement.

Referring to FIGS. 3B-3E, side views corresponding to support column 301 in accordance with one or more embodiments of the present disclosure are shown. Specifically, FIG. 3B is a side view showing one side of the support column 301 shown in FIG. 3A. In particular, as shown in FIG. 3B, region 305 may be a rounded edge joining sides 303A and 303B. In this view, a transition region 311 is shown. Here, the joining of sides 303A and 303B may gradually transition from a rounded edge to a squared edge and beginning (or ending) at a low portion along a length of the support column 301. The transitioning begins (or ends) at transition position 306. The transition position 306 may extend along any portion, or the entirety, of the length of the support column 301. Additionally, region 307 represents the vertical and generally flat surface of side 303A. Further, and similar to region 305, region 309 may be a rounded edge joining sides 303A and 303E. Likewise, the joining of sides 303A and 303E may gradually transition from a rounded edge to a squared edge that may terminate at a low portion along a length of the support column 301. Again, the transitioning may begin at transition position 306.

Similar to FIG. 3B, FIG. 3C is a side view showing another side of the support column 301 shown in FIG. 3A. As seen in FIG. 3C, region 305 may be a rounded edge joining sides 303A and 303B. Accordingly, the joining of sides 303A and 303B may gradually transition from a rounded edge to a squared edge and beginning (or ending) at a low portion along a length of the support column 301. Similar to region 305, region 313 may be a rounded edge joining sides 303B and 303C. Additionally, region 315 represents the vertical and generally flat surface of side 303B.

Figure 3D:
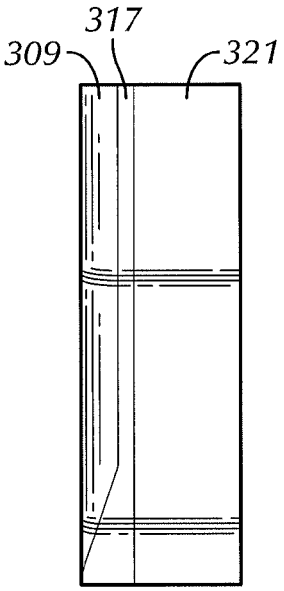

FIG. 3D is a side view showing another side of the support column 301 shown in FIG. 3A. As shown in FIG. 3D, region 309 illustrates a rounded edge joining sides 303A and 303E. Accordingly, the joining of sides 303A and 303E may gradually transition from a rounded edge to a squared edge and beginning (or ending) at a low portion along a length of the support column 301. Additionally, region 317 represents the vertical and generally flat surface of side 303E. Here, region 321 shows a chamfered surface corresponding to side 303D.

Figure 3E:
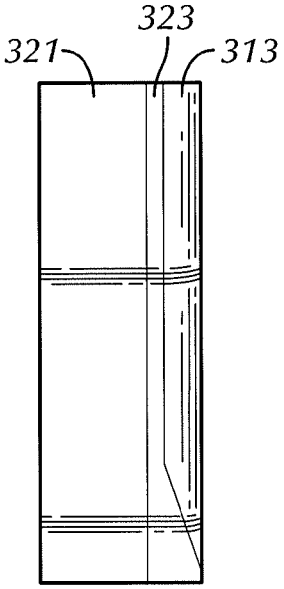

Similar to FIG. 3D, FIG. 3E is a side view showing another side of the support column 301 shown in FIG. 3A. As seen in FIG. 3E, region 321 may be a chamfered surface corresponding to side 303D. Additionally, region 323 represents the vertical and generally flat surface of side 303C. Further, region 313 illustrates a rounded edge joining sides 303C and 303D. Accordingly, the joining of sides 303C and 303D may gradually transition from a rounded edge to a squared edge and beginning (or ending) at a low portion along the length of the support column 301.

One of ordinary skill in the art would know that illustrations of FIGS. 3B-3E may not be limited to the arrangement described above. Specifically, the transition regions transitioning from rounded (or any alternative) to squared (or any alternative) edges may be from one end of the support column to an opposite end of the support column along the length, or may only be across a portion of the length of the support column. One of ordinary skill in the art would know and appreciate that transition surfaces, rounded surfaces, squared surfaces, and chamfered surfaces may be present in any of the embodiments disclosed herein. Further, one or more sides may transition in a manner whose cross-sections differ at the point of the beginning of the transition to the point of the end of the transition. In addition, one or more sides may not be continuous.

For example, at least one of the sides of the support column may, instead of gradually, suddenly transition. Further, the sides of the support column may not be parallel with respect to one another. In addition, transitioning one or more sides of a support column may or may not exist. Furthermore, one or more support columns may be positioned to overhang or underhang with respect to the pontoon structure. Furthermore, the number of sides, edges, and surfaces may not be limited to the illustrations and descriptions above.

Figure 4B:
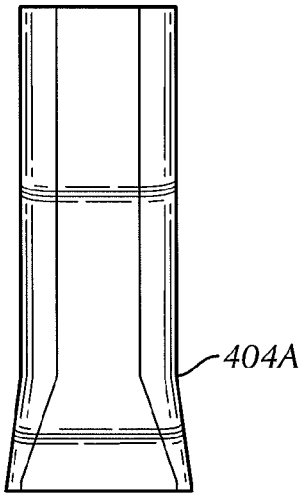
FIGS. 4A-4E illustrate several views of a multi-sided column in accordance with one or more embodiments of the present disclosure.
Figure 4C:
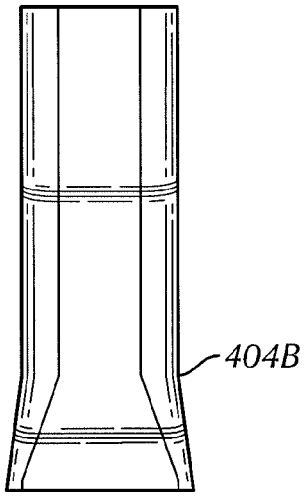
Figure 4A:
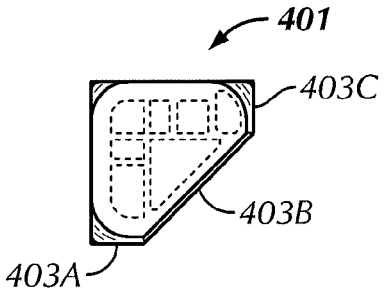
Figure 4D:
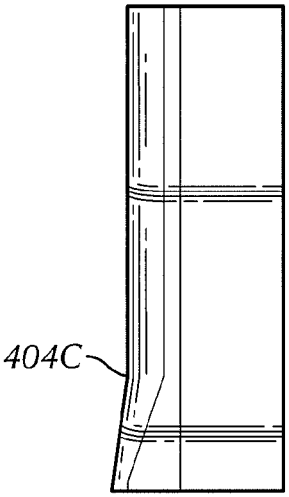
Figure 4E:
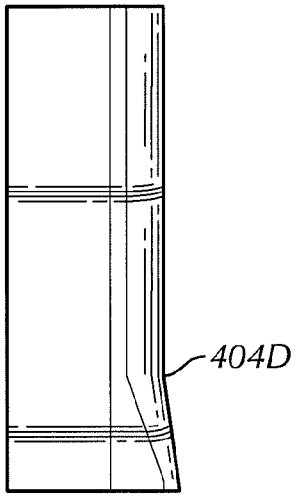

Referring now to FIG. 4A, a top view of an alternate embodiment of a support column in accordance with the present disclosure is shown. Specifically, FIG. 4A shows a top view of a support column 401 having one or more sides 403A, 403B, and 403C. As shown, the one or more sides 403A, 403B, and 403C may extend outwardly along at least a portion of the support column 401. The outward extension, or "flaring," as shown, may be provided for additional support at the base of the support column 401. In addition, one of ordinary skill in the art would appreciate that the extension may be inward (not shown).

A side view of the support column 401 with a flared base is shown in FIGS. 4B-4E. Taper positions 404A, 404B, 404C, 404D represent the vertical position along the column at which the tapering or flaring begins (or ends). One of ordinary skill in the art would know and appreciate that flaring is not limited to the base of the support column 401, as shown. In some cases, flaring may exist at either or both ends of a support column and may be used for additional support of, for example, either the support column 401 disposed on a pontoon structure, or, for example, to support a deck disposed on the support column 401. Additionally, flaring may result in cross-sections that are different along vertical positions of the support column (not shown). Additionally, transition regions, similar to those described in FIGS. 3A-3E, may extend along at least a portion of the length of the support column 401 and the regions may also extend along the flaring. Further, taper positions and transitions positions do not have to be at the same position along the length of the support column 401 and may be located at any position along the support column 401.

Figure 5B:
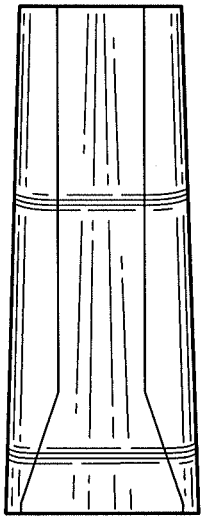
FIGS. 5A-5E illustrate several views of a multi-sided column in accordance with one or more embodiments of the present disclosure.
Figure 5C:
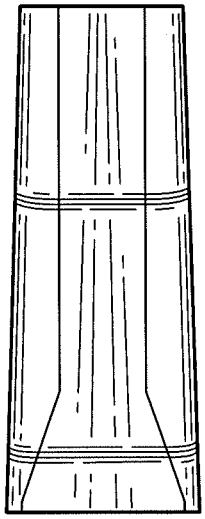
Figure 5A:
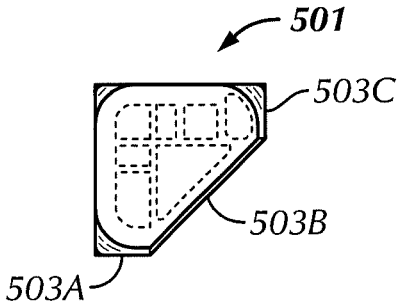
Figure 5D:
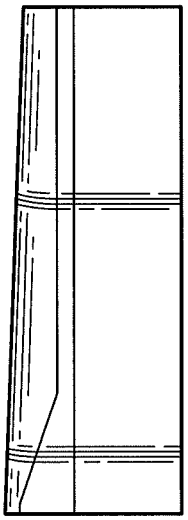
Figure 5E:
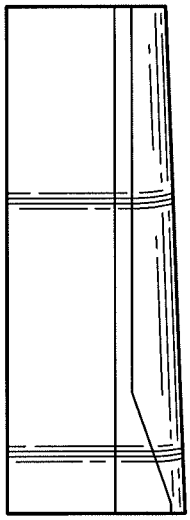

Referring now to FIG. 5A, a top view of an alternate embodiment of a support column in accordance with the present disclosure is shown. Specifically, FIG. 5A shows a top view of a support column 501 having one or more sides 503A, 503B, and 503C. As shown, the one or more sides 503A, 503B, and 503C may extend outwardly (or inwardly) beginning at one end to another end of the support column 501. In this example, taper positions similar to those described above in FIGS. 4B-4E do not exist along a portion of the length of the support column 501. In particular, as shown in FIGS. 5B-5E, the flaring spans the entire length of the support column 501. Accordingly, the taper position may be at either or both ends of the support column and the flaring may extend along the entirety of the support column 501. Further, in this example, side 503B may not flare. Therefore, flaring may occur on any number of sides or none.

Figure 6B:
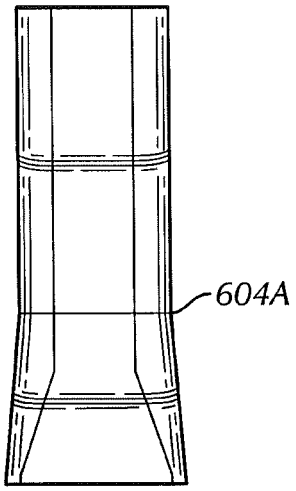
FIGS. 6A-6E illustrate several views of a multi-sided column in accordance with one or more embodiments of the present disclosure.
Figure 6C:
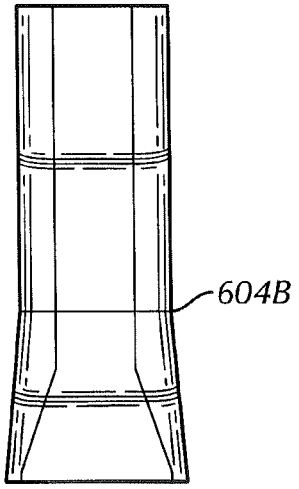
Figure 6A:
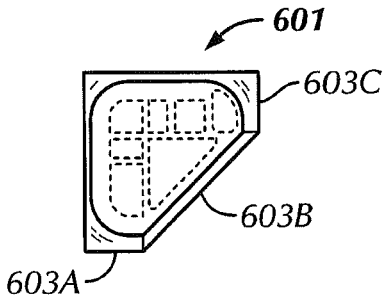
Figure 6D:
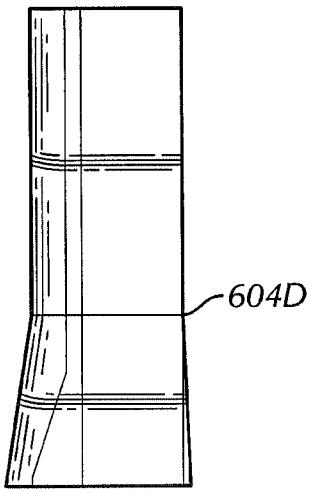
Figure 6E:
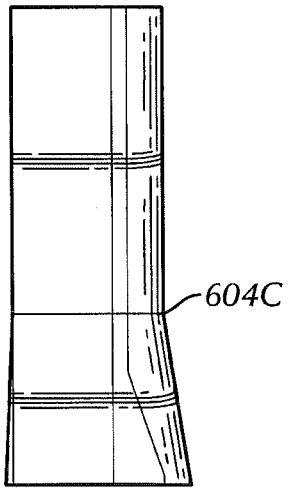

Referring now to FIG. 6A, a top view of an alternate embodiment of a support column in accordance with the present disclosure is shown. Specifically, FIG. 6A shows a top view of a support column 601 having one or more sides 603A, 603B, and 603C. A side view of the support column 601 with a flared base is shown in FIGS. 6B-6E. Taper positions 604A, 604B, 604C, 604D represent the vertical position along the column at which the taper or flaring begins or ends. In this example, the side 603B also flares, as shown in FIGS. 6A-6E. One of ordinary skill in the art would know and appreciate that the taper positions may be at any position along the length of the support column 601.

Figure 7B:
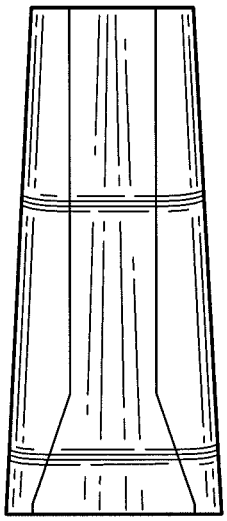
FIGS. 7A-7E illustrate several views of a multi-sided column in accordance with one or more embodiments of the present disclosure.
Figure 7C:
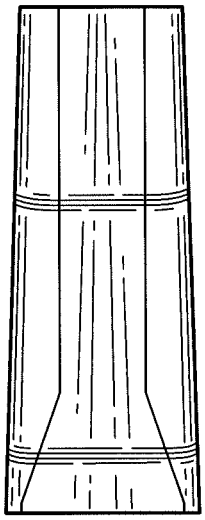
Figure 7A:
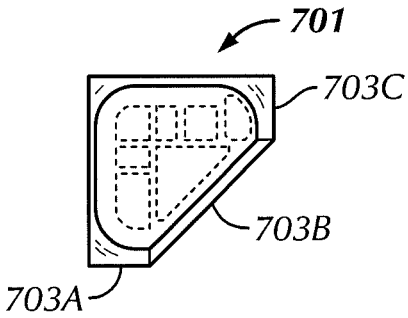
Figure 7D:
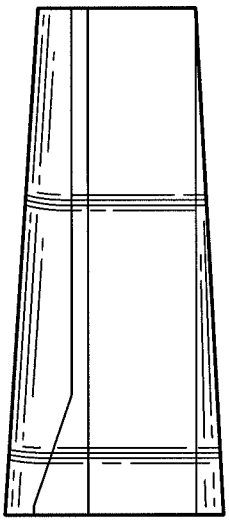
Figure 7E:
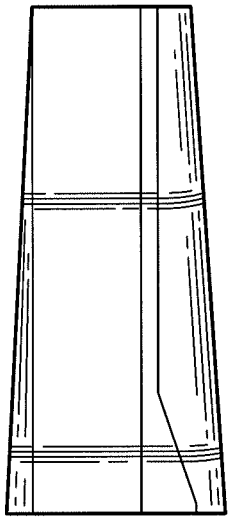

Referring now to FIG. 7A, a top view of an alternate embodiment of a support column in accordance with the present disclosure is shown. Specifically, FIG. 7A shows a top view of a support column 701 having one or more sides 703A, 703B, and 703C. A side view of the support column 701 with a flared base is shown in FIGS. 7B-7E. In this example, taper positions similar to those described above in FIGS. 6B-6E do not exist along any portion of the length of support column 701. In particular, as shown in FIGS. 7B-7E, the flaring spans the entire length of the support column 701. Accordingly, the taper position may be at either or both ends of the support column and the flaring may extend along the entirety of the support column 701. Further, in this example, side 703B may or may not flare. Therefore, flaring may occur on any number of sides or none.

Figure 8A:
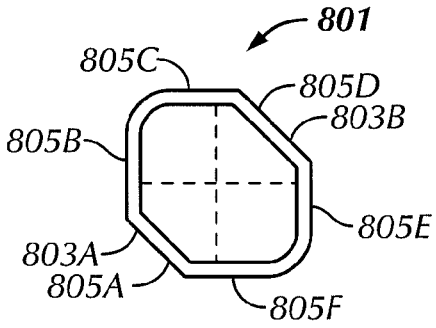
FIGS. 8A-8D illustrate several views of a multi-sided column in accordance with one or more embodiments of the present disclosure.

Referring now to FIG. 8A, a top view of an alternate embodiment of a support column in accordance with the present disclosure is shown. Specifically, a six-sided support column 801 is shown as another example of a multi-sided column. As shown in FIG. 8A, the support column 801 has one or more chamfered sides 803A and 803B. The one or more chamfered sides 803A and 803B of the support column 801 may not be limited to an interior or an exterior with respect to a pontoon structure. In addition, and as shown in FIG. 8A, the cross-section of a support column 801 may include one or more edges 805A, 805B, 805C, 805D, 805E, and 805F that correspond to one or more sides of the support column 801.

Figure 8B:
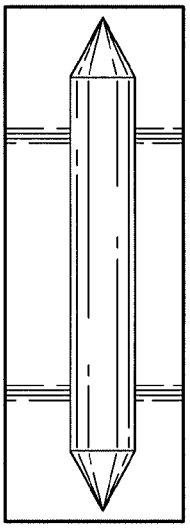
Figure 8C:
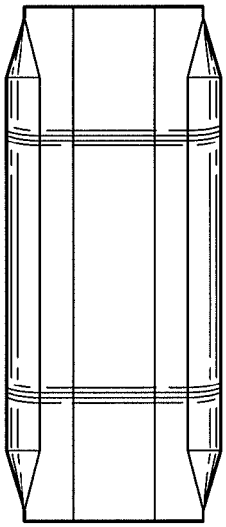
Figure 8D:
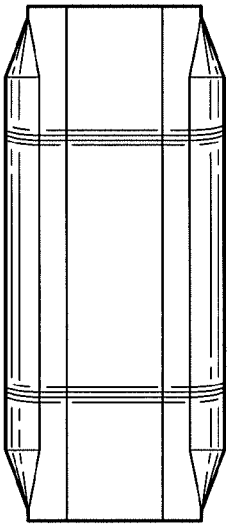

The edges 805A, 805B, 805C, 805D, 805E, and 805F may be arranged as shown in FIG. 8A. In particular, first edge 805A may be disposed at a first angle with respect to edge 805B. Edge 805B may be disposed at a second angle with respect to edge 805C. Edge 805C may be disposed at a third angle with respect to edge 805D. Edge 805D may be disposed at a fourth angle with respect to edge 805E. Edge 805E may be disposed at a fifth angle with respect to edge 805F. Edge 805F may be disposed at a sixth angle with respect to edge 805A. In addition, edges 805C and 805F may be chamfered and may correspond to chamfered sides 803A and 803B of the support column 801. In this example, the second and fifth angles may be substantially right angles and the first, third, fourth, and sixth angles may be substantially obtuse angles. An example obtuse angle may be substantially 135 degrees, as shown. However, an obtuse angle may be anywhere between any angle greater than 90 degrees and less than 180 degrees. Additionally, an obtuse angle may be anywhere between 91 and 179 degrees, 100 and 170 degrees, 110 and 160 degrees, 120 and 150 degrees, or 130 and 140 degrees. In FIGS. 8B-8D, side views of the six sided column of FIG. 8A are shown. One skilled in the art would know and appreciate that the six sided column may or may not include any or all of the features disclosed herein with respect to any of the embodiments of the multi-sided column as described above. For example, in one or more embodiments, the six sided column may include one or more of the following: one or more transition regions, one or more taper positions, and flaring. In addition, in one or more embodiments, the six sided column may include one or more of the following: rounded edges or corners, squared edges or corners, and chamfered edges or corners. As understood by one having ordinary skill, the aforementioned features are provided as examples and the embodiments herein should not be limited to those above features.

Further, a six sided column in accordance with the present disclosure may disposed on a pontoon structure (not shown) in that one or more sides of the support column may be flush with either the interior of the pontoon structure or the exterior of the pontoon structure or both (not shown). In addition, a six sided column in accordance with the present disclosure may have at most two axes of symmetry. However, one skilled in the art would know and appreciate that embodiments of the present disclosure may not be limited to at most two axes of symmetry. Embodiments herein may have any number of axes of symmetry.

A support column or semi-submersible structure in accordance with one or more embodiments of the present disclosure may be helpful in multiple areas, such as within the oil and gas industry. For example, a support column in accordance with one or more embodiments of the present disclosure may be used to support an operation deck. In addition, a semi-submersible in accordance with one or more embodiments of the present disclosure may have multi-sided support columns that would minimize the effects of forces caused by current, vortex induced motions, and/or waves. Further, as discussed above, a support column in accordance with one or more embodiments of the present disclosure may be used for additional support.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. An apparatus comprising:

an offshore structure including a support structure supporting a deck of the offshore structure, the support structure comprising:

a column having six sides;

a first side of the column and a second side of the column disposed at a first angle with respect to each other;

the second side of the column and a third side of the column disposed at a second angle with respect to each other;

the third side of the column and a fourth side of the column disposed at a third angle with respect to each other;

the fourth side of the column and a fifth side of the column disposed at a fourth angle with respect to each other;

the fifth side of the column and a sixth side of the column disposed at a fifth angle with respect to each other; and the sixth side of the column and the first side of the column disposed at a sixth angle with respect to each other.

2. The structure of claim 1, wherein the second and fifth angles are substantially right angles and the first, third, fourth, and sixth angles are substantially obtuse angles.

3. The structure of claim 2, wherein the substantially obtuse angle is about 135 degrees.

4. The structure of claim 1, wherein at least one side of the column comprises a taper position such that the at least one side flares outwardly or inwardly along at least a portion of the length of the column.

5. The structure of claim 4, wherein the at least one side of the column flares outwardly or inwardly along an entire length of the column.

6. The structure of claim 4, wherein each of the sides of the column comprises a taper position.

7. The structure of claim 6, wherein each taper position is disposed at a different position along a length of the column.

8. The structure of claim 1, wherein a cross section of the column comprises at most two axes of symmetry.

9. The structure of claim 1, wherein at least one connection formed along a length of the column between at least two sides of the column forms a rounded edge or a squared edge.

10. The structure of claim 1, wherein the column comprises a first point and a second point, the first point having at least one connection between at least two sides of the column with a rounded edge and the second point having at least one connection between the at least two sides of the column with a squared edge.

11. The structure of claim 10, further comprising a transition region extending between the first point and the second point.

12. The structure of claim 1, wherein the column has six sides at a first cross-section thereof and at most five sides at a second cross-section thereof.

13. The structure of claim 1, wherein the structure is floating.

14. A method of manufacturing a column for an offshore structure, the method comprising:

disposing a first side of the column and a second side of the column at a first angle with respect to each other;

disposing the second side of the column and a third side of the column at a second angle with respect to each other;

disposing the third side of the column and a fourth side of the column at a third angle with respect to each other;

disposing the fourth side of the column and a fifth side of the column at a fourth angle with respect to each other;

disposing the fifth side of the column and a sixth side of the column at a fifth angle with respect to each other;

disposing the sixth side of the column and the first side of the column at a sixth angle with respect to each other; and attaching the column to a pontoon structure.

15. The method of claim 14, wherein the first and sixth angles are substantially right angles and the second, third, fourth, and fifth angles are substantially obtuse angles.

16. The method of claim 14, wherein at least one side of the column comprises a taper position such that the at least one side flares outwardly or inwardly along at least a portion of the length of the column.

17. The method of claim 16, wherein the at least one side of the column flares outwardly or inwardly along an entire length of the column.

18. The method of claim 14, wherein each of the sides of the column comprises a taper position.

19. The method of claim 14, wherein a cross section of the column comprises at most two axes of symmetry.

20. An apparatus comprising:

an offshore structure including a support structure comprising:

a column having five sides;

a first side of the column and a second side of the column disposed at a first angle with respect to each other;

the second side of the column and a third side of the column disposed at a second angle with respect to each other;

the third side of the column and a fourth side of the column disposed at a third angle with respect to each other;

the fourth side of the column and a fifth side of the column disposed at a fourth angle with respect to each other; and the fifth side of the column and the first side of the column disposed at a fifth angle with respect to each other; and a pontoon structure disposed at a lower end of the column, wherein at least one side of the column comprises a taper position such that the at least one side flares outwardly or inwardly along at least a portion of the length of the column.

21. The structure of claim 20, wherein the first, second, and fifth angles are substantially right angles, and the third and fourth angles are substantially obtuse angles.

22. The structure of claim 20, further comprising a transition region extending along at least a portion of a length of the column such that the joining of at least two sides transitions from a rounded edge to a squared edge.

23. The structure of claim 20, wherein the at least one side of the column flares outwardly or inwardly along an entire length of the column.

24. The structure of claim 20, wherein each of the sides of the column comprises a taper position.

25. The structure of claim 20, wherein a cross section of the column comprises at most two axes of symmetry.

26. The structure of claim 20, wherein the column has five sides at a first cross-section thereof and six sides at a second cross-section thereof.

27. The structure of claim 20, wherein the structure is floating.

28. An apparatus comprising:

an offshore structure including a support structure comprising:

a column having six sides;

a first side of the column and a second side of the column disposed at a substantially right angle with respect to each other;

the second side of the column and a third side of the column disposed at a substantially obtuse angle with respect to each other;

the third side of the column and a fourth side of the column disposed at a substantially obtuse angle with respect to each other;

the fourth side of the column and a fifth side of the column disposed at a substantially right angle with respect to each other;

the fifth side of the column and a sixth side of the column disposed at a substantially obtuse angle with respect to each other;

the sixth side of the column and the first side of the column disposed at a substantially obtuse angle with respect to each other; and a pontoon structure disposed at a lower end of the column.

29. An apparatus comprising:

an offshore structure including a support structure supporting a deck of the offshore structure, the support structure comprising:

a column having five sides;

a first side of the column and a second side of the column disposed at a substantially right angle with respect to each other;

the second side of the column and a third side of the column disposed at a substantially right angle with respect to each other;

the third side of the column and a fourth side of the column disposed at a substantially obtuse angle with respect to each other;

the fourth side of the column and a fifth side of the column disposed at a substantially obtuse angle with respect to each other; and the fifth side of the column and the first side of the column disposed at a substantially right angle with respect to each other, wherein at least one side of the column comprises a taper position such that the at least one side flares outwardly or inwardly along at least a portion of the length of the column.

30. A method of manufacturing a column for an offshore structure, the method comprising:

disposing a first side of the column and a second side of the column at a first angle with respect to each other;

disposing the second side of the column and a third side of the column at a second angle with respect to each other;

disposing the third side of the column and a fourth side of the column at a third angle with respect to each other;

disposing the fourth side of the column and a fifth side of the column at a fourth angle with respect to each other; and disposing the fifth side of the column and a sixth side of the column at a fifth angle with respect to each other, attaching the column to a pontoon structure.

31. The method of claim 30 wherein the first and sixth angles are substantially right angles and the second, third, fourth, and fifth angles are substantially obtuse angles.

32. The method of claim 30, wherein at least one side of the column comprises a taper position such that the at least one side flares outwardly or inwardly along at least a portion of the length of the column.

33. The method of claim 32, wherein the at least one side of the column flares outwardly or inwardly along an entire length of the column.

34. The method of claim 30, wherein each of the sides of the column comprises a taper position.

35. The method of claim 28, wherein a cross section of the column comprises at most two axes of symmetry.

* * * * *